United States Patent [19]

Beckley

[11] 4,046,417

[45] Sept. 6, 1977

[54] FOLDING FURNITURE PIECE

[76] Inventor: Charles R. Beckley, 2708 Woodley Place, NW., Washington, D.C. 20008

[21] Appl. No.: 707,085

[22] Filed: July 20, 1976

[51] Int. Cl.[2] ..... A47B 85/04

[52] U.S. Cl. ..... 297/16; 297/122

[58] Field of Search ..... 297/122, 124, 16, 125–128

[56] References Cited

U.S. PATENT DOCUMENTS

| | | | |
|---|---|---|---|
| 1,153,358 | 9/1915 | Vaill | 297/122 |
| 1,271,830 | 7/1918 | Austin | 297/128 |
| 1,513,651 | 10/1924 | Stone | 297/122 |
| 2,060,000 | 11/1936 | Nelson | 297/122 |
| 2,786,512 | 3/1957 | Moyer | 297/122 |
| 3,058,776 | 10/1962 | Collum | 297/122 |
| 3,856,345 | 12/1974 | Beckley | 297/16 |

*Primary Examiner*—Roy D. Frazier
*Assistant Examiner*—Darrell Marquette
*Attorney, Agent, or Firm*—Bacon & Thomas

[57] ABSTRACT

A folding furniture piece is convertible to either a seat or a table. In addition, the furniture piece is foldable to a compact unit for storage and transport. The furniture piece includes a pair of arms which are supported by two pairs of legs, which pivot against the arms to fold the furniture piece. Bottom and back panels are pivoted between the arms to form a table when coplanar with one another and a seat when oblique to one another.

14 Claims, 8 Drawing Figures

FIG. 5
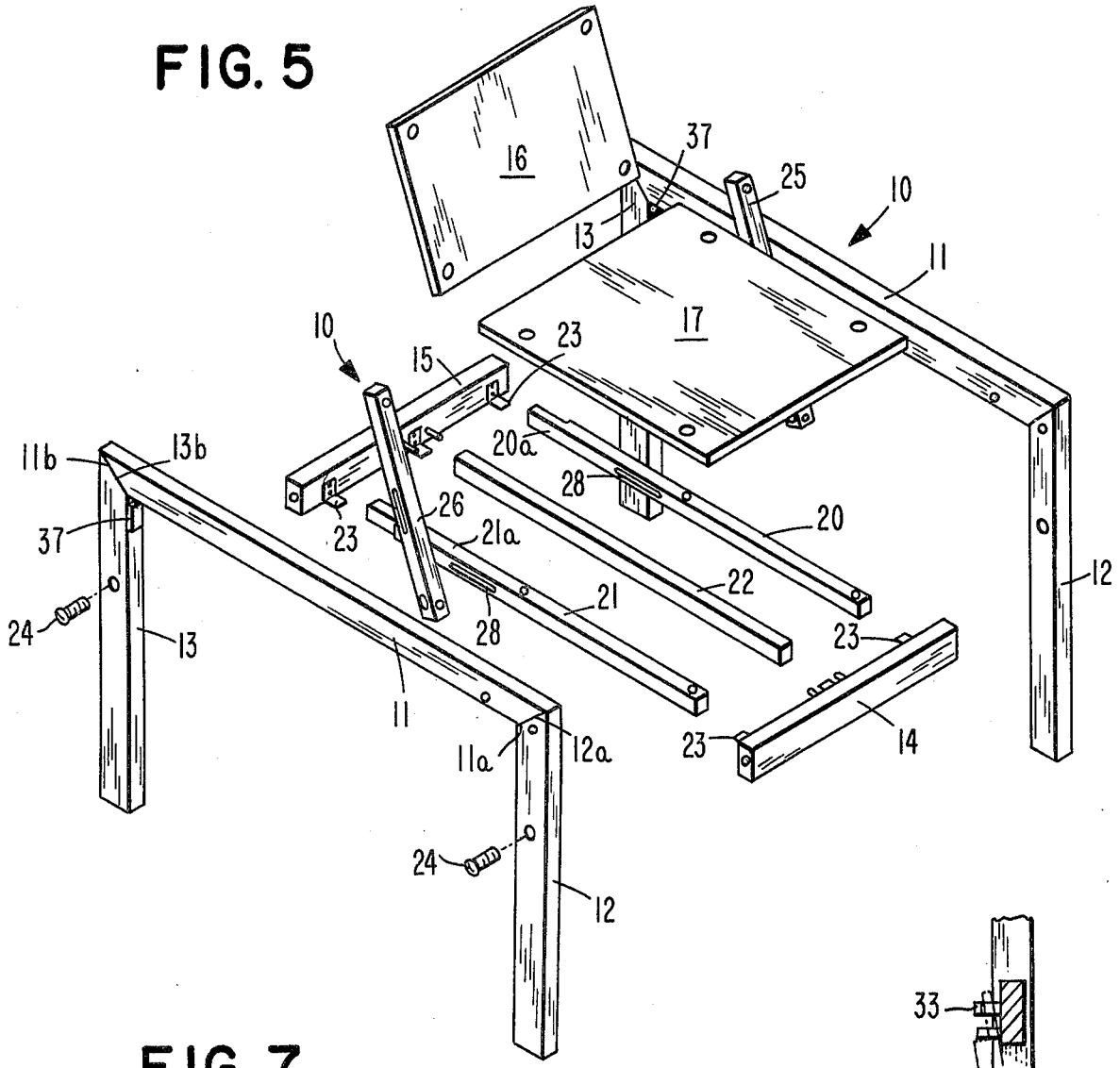
FIG. 7
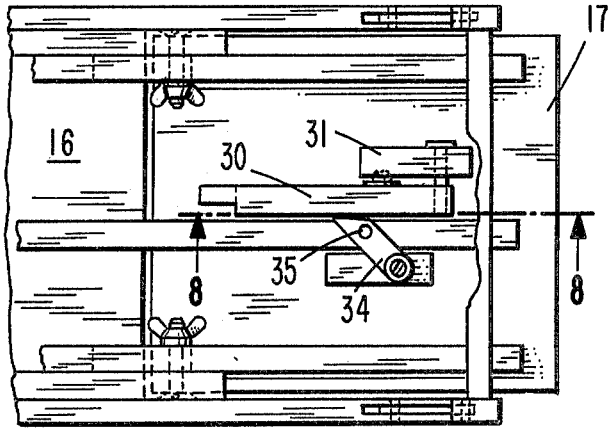
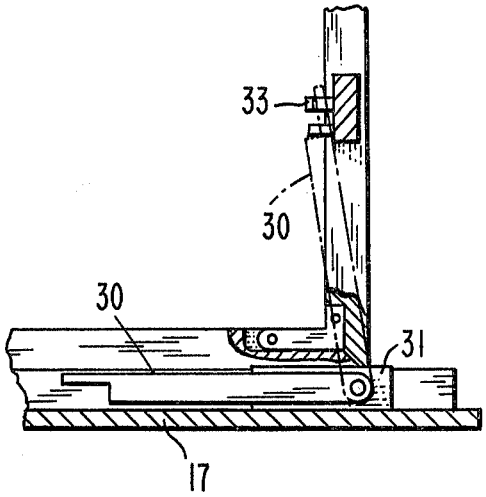
FIG. 8

FOLDING FURNITURE PIECE

BACKGROUND OF THE INVENTION

Field of the Invention

The instant invention relates to furniture, and more particularly, the instant invention relates to folding and convertible furniture.

Prior Art and Other Considerations

In the past, it has proved difficult to construct a seat, which is both foldable for convenient transport and storage and is comfortable to most people when used. This is because the structure, which allows the seat to fold, often interferes with structure which makes the seat comfortable.

In addition, the prior art does not provide may seats, which have an attractive appearance appearance both when folded and erected. Generally, the seats disclosed in the prior art are not self-supporting when in the folded condition and, therefore, tend to fall over when stored.

In addition, it is also desirable to provide a seat, which one can readily convert into a table, if necessary or desired. Again, the prior art does not disclose a folding seat, which is readily convertible into a table and which has a pleasing appearance both as a seat and a table, and as a folded piece of furniture.

U.S. Pat. No. 3,856,345 discloses a foldable seat, which is self-supporting when stored, and which presents a pleasing appearance when both erect and stored. However, this chair utilizes a sling-type seat. This type of seat of seat is not comfortable to all users, although it is generally comfortable. In addition, the sling does not have sufficient stiffness to enable one to use the chair disclosed in this patent, as a table, nor is there any structure in this patent which would suggest converting this chair into a table.

In view of these and other considerations, there is a need for an additional seat which obviates the above-cited drawbacks in seats of the prior art.

OBJECTS OF THE INVENTION

It is, therefore, an object of the instant invention to provide new and improved foldable furniture.

It is another object of the instant invention to provide a new and improved foldable seat, which is also foldable to assume the configuration of a table.

It is another object of the instant invention to provide a new and improved foldable seat, which is both comfortable and pleasing in appearance when erected and when folded.

It is still another object of the instant invention to provide new and improved foldable furniture which is flat and is self-supporting when folded.

It is a further object of the instant invention to provide a new and improved foldable seat, which is easy to completely assemble and disassemble.

SUMMARY OF THE INVENTION

With these objects in mind, the instant invention contemplates a seat comprising a pair of armrests having front and rear ends with a back pivoted between the arm rests at points intermediate the ends of the armrests. The armrests are supported in spaced relation to the surface upon which the chair is placed, and a bottom is pivotally connected to the back and supported at a level beneath the armrests on front and rear spacers disposed at a level beneath the armrests. The bottom and back cooperate to form a seat when the bottom is supported on the front spacer, and the bottom and back pivot relative to one another, as the back pivots relative to the arms, so that the bottom and back become co-planar with one another and the arms when the seat is folded for storage or configured for use as a table.

BRIEF DESCRIPTION OF THE DRAWINGS

FIG. 5 is an exploded view of the furniture of the instant invention showing various elements thereof;

FIG. 7 is a bottom planar view of the folding furniture, according to the instant invention, when the furniture is folded; and FIG. 8 is a side view partly cut away showing how a post is pivoted from a bottom panel, in order to support the bottom panel when the furniture is configured as a table.

DETAILED DESCRIPTION

Figure 1:
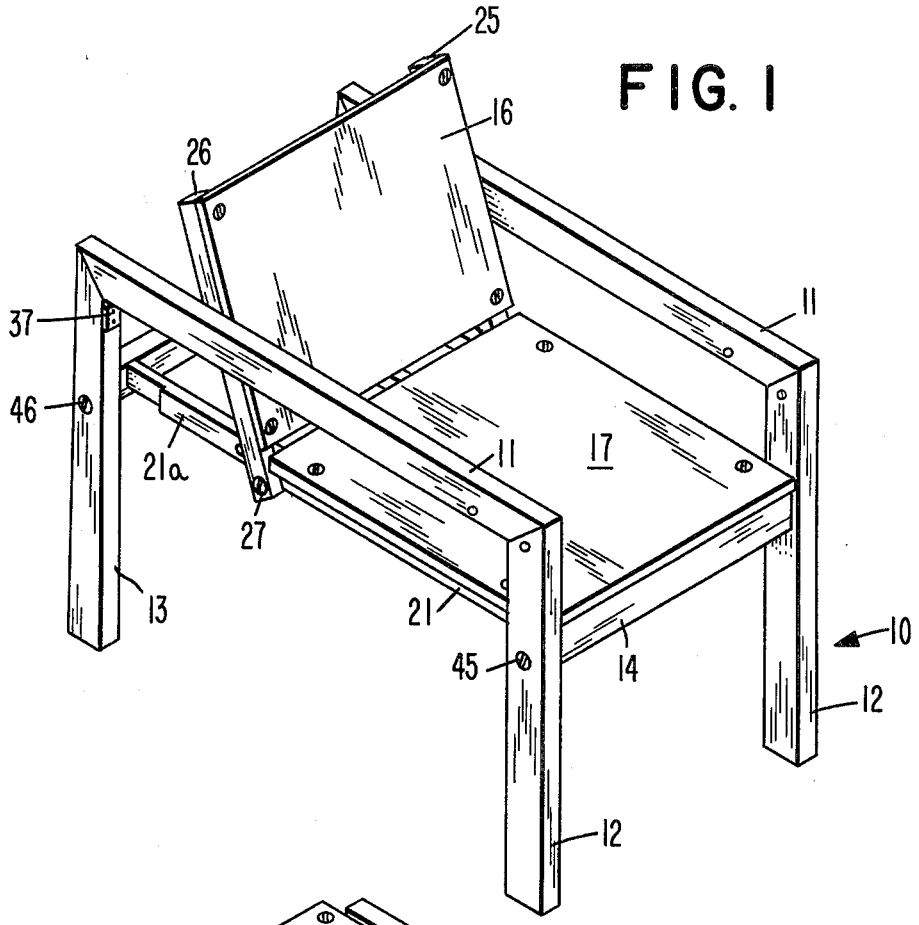
FIG. 1 is a perspective view showing the folding furniture of the instant invention cnfigured as a seat.

Referring now to FIG. 1, there is shown a piece of folding furniture, designated generally by numeral 10, according to the instant invention, configured in the form of a seat. In FIG. 1, the seat is configured as a chair, however, it should be kept in mind that the seat can be enlarged to accommodate two or more persons, if desired.

Figure 2:
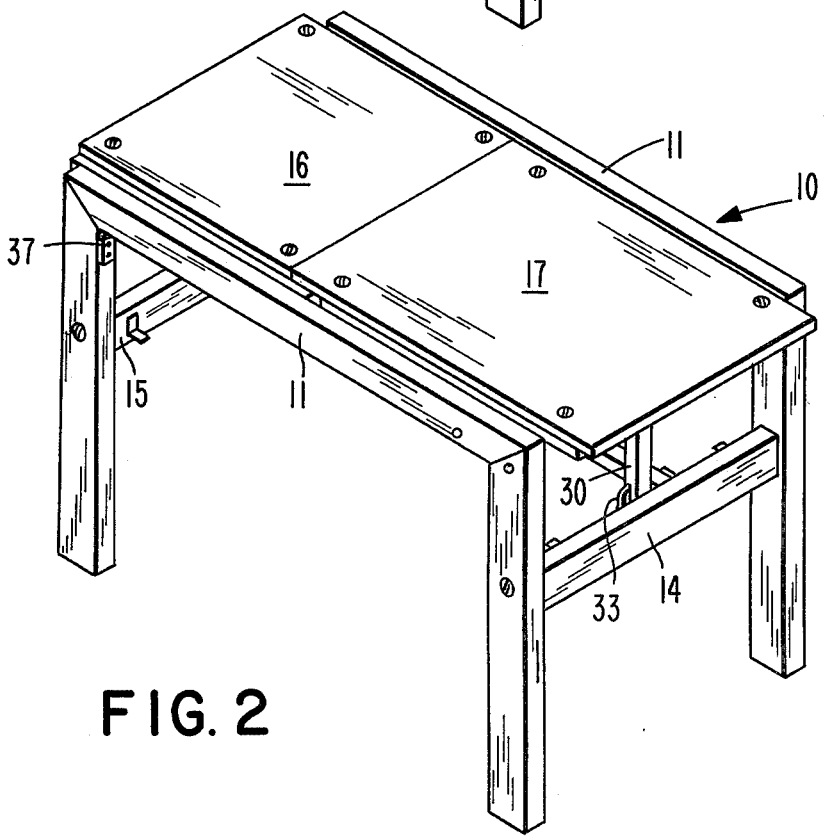
FIG. 2 is a perspective view showing the folding furniture of the instant invention configured as a table.
Figure 3:
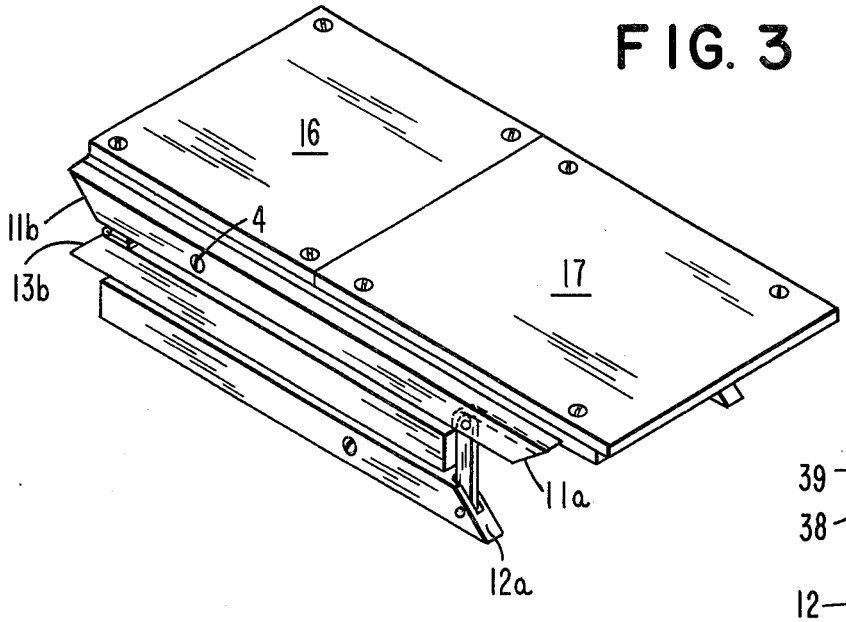
FIG. 3 is a perspective view showing the folding furniture of the instant invention folded for storage.
Figure 4:
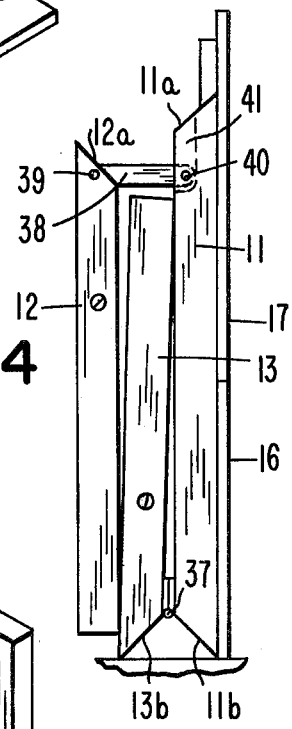
FIG. 4 is a side view of the folding furniture of the instant invention sat on one end for storage while in a folded configuration.
Figure 6:
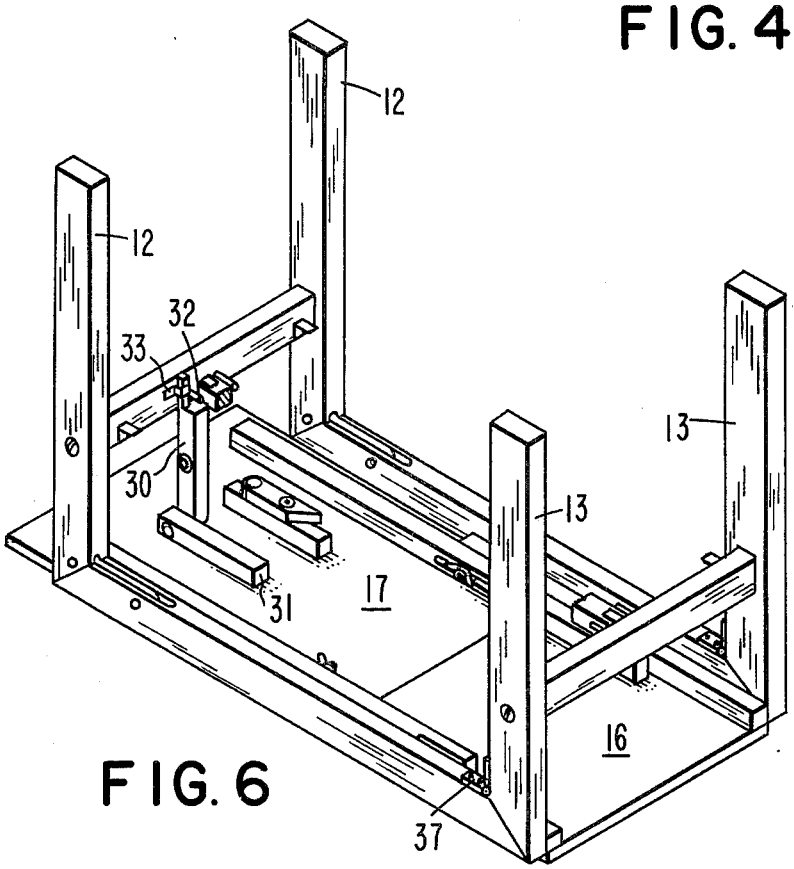
FIG. 6 is a bottom view in perspective of the folding furniture, according to the instant invention, showing the structure of the furniture when configured as a table.

Using the same structural elements, the furniture piece 10 of FIG. 1 can be reorganized into the configuration of a table, as shown in FIG. 2 or can be folded for storage, as shown in FIGS. 3 and 4.

The various elements composing the piece of furniture 10 are shown in exploded view of FIG. 5. As is seen in FIG. 5, the furniture piece 10 consists of a pair of arms 11, each of which has a front leg 12 and a rear leg 13 attached thereto. As will be explained hereinafter, the arms 11 and front and rear legs 12 and 13 form foldable side frames, which may be collapsed when the piece of furniture is stored.

The front legs 12 are separated by a front rung 14 and the rear legs 13 are separated by a rear rung 15. The front and rear rungs, in effect, serve as spacers to hold the side frames in spaced relation.

In order to form the seating and table surfaces for the seat and table configurations of FIGS. 1 and 2, respectively, the furniture pieces are provided with a back panel 16 and a bottom panel 17. When the furniture piece is in the seat configuration, the back panel 16 serves as the back of the seat, and the bottom panel 17 serves as the bottom of the seat. When the furniture piece is in the table configuration, the back panel 16 and bottom panel 17 are coplanar. While the panels 16 and 17 are shown as flat solid members, the panels may also assume any similar configuration. For example, the panels may be frames with cane or mesh inserts. When the chair is configured as a seat, pillows, cushions, or the like, may be rested or otherwise supported on the panels 16 and 17 to make a soft seating surface.

Attached to the bottom panels 17 are side rails 20 and 21, and a center rail 22. The rails 20, 21 and 22 serve as braces to keep the legs from pivoting and chair from folding. Side rails 20 and 21 are supported on shelves 23, which project from the front and rear rungs 14 and 15. Since the bottom panel 17 rests on the rails 20 and 21, the bottom panel is, in effect, supported by the front and rear rungs 14 and 15. The center rung 22 also helps support the bottom panel 17 when the furniture piece 10 is used as a seat. However, the rail 22 is used to hold the front and rear legs 12 and 13 apart when the furniture is configured as a table by extending between the front and rear rungs 14 and 15 which are, in turn, detachably secured to the front pair and rear pair of legs, respectively, by bolts 24.

The back panel 16 is attached to back support bars 25 and 26 which are, in turn, pivoted to arms 11 so that the back panel 16 can be rotated from the position shown in FIG. 1 to the position shown in FIGS. 2, 3 and 4, where it is parallel with the arms 11. At their lower end, the bars 25 are connected to the rails 20 and 21 by bolts 27, which register with slots 28 in the side rails. When the back 16 is rotated counterclockwise, it lifts the rails 20 and 21 from the position of FIG. 1 to the position shown in FIG. 2, where the bottom panel 17 is parallel with the back panel 16. This is because the bottom panel 17 is rigidly secured to the rails 20 and 21. In the position of FIG. 2, the rails 20 and 21 have rear portions 21*a* and 20*a*, which fit beneath the back panel 16 and thereby assist in aligning the panels 16 and 17.

When the furniture piece 10 is in the seat configuration of FIG. 1, the side rails 20 and 21 extend between the front and rear rungs 14 and 15, thereby making sure that the legs 12 and 13 do not fold. When the furniture piece is in the FIG. 2 configuration, the side rails 20 and 21 position and align the bottom panel 17. When the furniture piece 10 is in the table configuration of FIG. 2, the center rail 22 is detached from the bottom panel 17 and remains between the front rung 14 and rear rung 15 to keep the legs 12 and 13 from folding.

Referring now to FIGS. 2, 6, 7 and 8, it is seen that a post 30 is pivotally secured to a block 31 on the underside of the bottom panel 17. When it is desired to configure the furniture piece as a table, the post 30 is pivoted to project from the bottom panel and engages a projection 32 extending from the front rung 14. The post 30 supports the front end of the bottom panel when the panel is in the table configuration of FIG. 2. While a post 30 is shown as the preferred embodiment it is also possible to support the bottom panel 17 in the FIG. 2 position by using other means, such as detents which may project from the bottom panel and engage openings in the front end of the armrests 11 or the top ends of front legs 12.

As seen in FIG. 7, the center rail 22 may be held attached to the bottom panel 17 by a latch arm 34, which has a detent 35 therein that engages the center rail at a point to properly position the center rail to seat between the front and rear rungs 14 and 15, when the furniture piece is configured as a seat, as shown in FIG. 1. A convenient form for the detent 35 may be a ball detent. In addition, the post 30 may also be held in engagement with the block 31 with a ball detent.

The arms 11 each have front and rear beveled portions 11*a* and 11*b*, which abut corresponding beleved portions 12*a* and 13*b* on the front and rear legs 12 and 13, respectively. The rear legs 13 are pivotally secured to the arms 11 by hinges 37 and fold along the arms to assume the configuration in FIG. 4, when the piece of furniture 10 is folded. When the piece of furniture is erect to form a chair or table, as shown in FIGS. 1 and 2, the beveled surfaces 11*b* and 13*b* abut one another to hold the rear legs 13 extended at a 90° angle from the arms 11.

The front legs 12 each have a link 38 rigidly secured theeto and extending at right angles therefrom. Each of the links 38 is pivoted to an arm 11 by pins 40. The links 38 are received in slots 41 extending in the arms, when the furniture is in the erect condition of FIGS. 1 and 2. When the furniture is folded for storage or transport, the links 38 extend pass the bottom end of the rear legs 13, so that the front legs extend along and over the rear legs 13. By using this arrangement, a relatively compact structure is achieved which is easy to store and carry.

As is seen in FIG. 4, when the furniture is folded, it can rest on the top of the rear legs 13 and the rear ends of the arm 11. The center of gravity of the structure is between the top of the rear leg 13 and the rear end of the arm 11, so that the furniture will remain upright and will not topple over.

For the sake of convenience, the front rung 14 is secured between the front legs 12 by bolts 45 and the rear rung 15 is secured between the rear legs 13 by bolts 46. When the bolts 45 and 46 are removed from both sides of the chair, the arm 11 and legs 12 and 13 on one side, and the arm 11 and legs 12 and 13 on the other side can be separated from the panels 16 and 17, so that the furniture can be disassembled to form a relatively thin package for shipping and transport. In this package, the sub-assemblies consisting of the arm and legs may be simply laid against the panels 16 and 17.

While the disclosed piece of furniture 10 is preferably made of wood, it may also be made of any other convenient material, such as plastic or aluminum.

The foregoing embodiment is merely illustrative of the invention, and the invention is limited only by the following appended claims:

What is claimed is:

1. A seat comprising:

a pair of armrests having front and rear ends, said armrests defining two sides of the seat;

a back pivoted to said armrests at points intermediate the ends of said armrests;

a bottom;

means for pivotally connecting said bottom to said back, wherein said bottom can pivot to be coplanar with said back and to be at an angle with said back;

spacer means extending between the two sides of the seat below the level of the armrests;

support means for supporting releasably the front end of the bottom at a level below the level of the armrests;

front and rear legs pivoted adjacent to the front and rear ends of each armrest, respectively, wherein the legs fold along the arms when the back and bottom are coplanar with one another to form a folded seat;

rigid bracing means, secured to and coextensive with said bottom for engaging adjacent to said front and rear legs on each side of said chair to keep said legs from folding; wherein the bottom and back cooperate to form a seat when the front end of the bottom is supported by said support means and wherein the bottom pivots relative to the back, as the back pivots relative to the armrests, so that the back and bottom become coplanar with one another and with the armrests.

2. The seat of claim 1, wherein the arms extend horizontally when the seat is not folded, and wherein the back and bottom extend horizontally when coplanar with the armrests to form a table.

3. The seat of claim 1, wherein the front and rear legs pivot toward one another to fold, wherein the spacer means includes a front spacer which extends between the front legs and a rear spacer which extends between the rear legs; and wherein the bottom includes a rigid rearwardly extending portion, which abuts the rear spacer while the front of the bottom abuts the front spacer to form said rigid bracing means to hold the front and rear legs apart when the seat is erect.

4. The seat of claim 3, wherein the front and rear legs pivot toward one another to fold, wherein the spacers means includes a front spacer which extends between the front legs and a rear spacer which extends between the rear legs; and wherein the bottom includes a rearwardly extending portion, which abuts the rear spacer while the front of the bottom abuts the front spacer to hold the front and rear legs apart when the seat is erect.

5. The seat of claim 3, wherein the bottom includes a pair of supporting rails affixed thereto, which form the rearwardly extending portion that abuts the rear spacer, and wherein the rails also project forward to abut the front spacer so as to form said rigid bracing means.

6. The seat of claim 3, wherein the rear legs are pivoted to the rear ends of said arms to extend along said arms directly adjacent thereto when folded, and wherein the front legs include projecting links, which are pivoted to the front end of said arms so that said front legs fold over said rear legs when said rear legs are folded to extend along said arms.

7. The seat of claim 6, wherein the rear end of the arm and top of the rear leg cooperate to support the folded seat, so that the seat stands on said end and top with the arms, legs, back and bottom extending vertically.

8. The seat of claim 3, wherein the seat includes a rail releasably secured to said bottom, which extends between said front and rear spacers to hold the front and rear legs apart when the back and bottom are in coplanar relationship and horizontally disposed to form a table.

9. The seat of claim 8, further including a support pivoted to said bottom which selectively pivots to project down from said bottom to engage the front spacer to thereby support the front of said bottom.

10. The seat of claim 10, wherein the bottom includes a rigid panel supported by a pair of rails, which extend between the front and rear spacers when the seat is in the configuration of a chair and wherein the rails fit beneath the back to support the back when the seat is configured as a table.

11. The seat of claim 10, wherein the back includes a rigid panel member secured to a pair of back rails, wherein the back rails are pivoted to the arm inboard of the arms, and wherein the back rails are pivoted to the bottom rails with the bottom rails inboard of the back rails so that when the back and bottom are coplanar the bottom rails are adjacent the back rails and directly beneath the back panel.

12. The seat of claim 11, wherein the pivots between the back and bottom are sliding pivots, so that the back may be angularly adjusted with respect to the bottom when the seat is configured as a chair.

13. A folding furniture piece comprising:

a back panel;

a bottom panel pivoted to the back panel;

a pair of armrests having front and rear ends with back and bottom panels disposed between the armrests and the back panel pivotally supported intermediate the ends of the armrests;

pairs of front and rear legs attached to the front and rear ends of the armrests, respectively, wherein the legs are separated by front and rear spacer rungs;

means for disposing the back and bottom panels at an angle to one another for form a seat; wherein the front and rear legs fold relative to the armrests so as to extend parallel therewith when the furniture is folded for storage and transport;

bracing means secured to the bottom panel and extending between the front and rear legs for preventing the legs from folding; and means for holding the back and bottom panels coplanar with one another and with the armrests to form a table surface when the legs are not folded.

14. The folding furniture piece of claim 13, wherein one pair of legs is pivoted directly to one end of each armrest and the other pair of legs have links projecting therefrom which are pivoted to the other end of each armrest, so that when the legs are folded one pair of legs is disposed between the armrests and the pair of legs.

* * * * *